United States Patent [19]

Guenkinger et al.

[11] Patent Number: 4,995,140

[45] Date of Patent: Feb. 26, 1991

[54] SLIVER CAN TRANSPORTING APPARATUS AND METHOD FOR A DRAW FRAME OF A TEXTILE MACHINE

[75] Inventors: Siegfried Guenkinger, Heiningen; Markus Wurster, Owen/Teck; Manfred Langen, Moenchengladbach; Gregor Gebald, Korschenbroich-Pesch, all of Fed. Rep. of Germany

[73] Assignee: Zinser Textilmaschinen GmbH, Ebersbach/Fils, Fed. Rep. of Germany

[21] Appl. No.: 482,555

[22] Filed: Feb. 2, 1990

[30] Foreign Application Priority Data

Feb. 21, 1989 [DE] Fed. Rep. of Germany ..... 3905279

[51] Int. Cl.[5] ..... B65G 65/30

[52] U.S. Cl. ..... 19/159 A

[58] Field of Search ..... 19/159 A, 159 R

[56] References Cited

U.S. PATENT DOCUMENTS

| | | | |
|---|---|---|---|
| 3,698,041 | 10/1972 | Hertzsch | 19/159 A |
| 3,884,026 | 5/1975 | Yoshizawa et al. | 19/159 AX |
| 4,227,848 | 10/1980 | Kriechbaum et al. | 19/159 AX |
| 4,694,539 | 9/1987 | Langen | 19/159 A |
| 4,735,040 | 4/1988 | Pircher | 19/159 A |

FOREIGN PATENT DOCUMENTS

| | | | |
|---|---|---|---|
| 0069087 | 1/1983 | European Pat. Off. | 19/159 A |
| 52999 | 7/1966 | Fed. Rep. of Germany . | |
| 0129746 | 6/1984 | Fed. Rep. of Germany . | |
| 362773 | 3/1988 | Fed. Rep. of Germany . | |
| 3707080 | 9/1988 | Fed. Rep. of Germany | 19/159 A |
| 3728929 | 4/1989 | Fed. Rep. of Germany | 19/159 A |
| 3809282 | 9/1989 | Fed. Rep. of Germany | 19/159 A |
| 3717778 | 10/1962 | Japan | 19/159 A |
| 1136782 | 12/1968 | United Kingdom . | |

*Primary Examiner*—Werner H. Schroeder
*Assistant Examiner*—John J. Calvert
*Attorney, Agent, or Firm*—Shefte, Pinckney & Sawyer

[57] ABSTRACT

A sliver can transporting apparatus and method for circulating sliver cans between a draw frame and a sliver supply station includes an inner track component and an outer track component. The outer track component transports empty sliver cans from the draw frame to a sliver supply station and the inner track component transports full sliver cans from the sliver supply station to form a row of full sliver cans at a final can ready position. Longitudinal bar members are selectively operated to transfer the full sliver cans in groupwise manner from the inner track components to the outer track component to allow another row of full cans to be supplied to the final can ready position and to transfer the rows of full sliver cans to the double rows of the draw frame. In correspondence with the transfer of the full sliver cans to the draw frame, empty sliver cans are discharged from the draw frame to be transported along the outer track component to a sliver supply station for refilling. Accordingly, the sliver can transporting apparatus continuously readies supplies of full sliver cans for replacement of sliver cans being emptied at the draw frame.

15 Claims, 6 Drawing Sheets

SLIVER CAN TRANSPORTING APPARATUS AND METHOD FOR A DRAW FRAME OF A TEXTILE MACHINE

BACKGROUND OF THE INVENTION

The present invention relates to a sliver can transporting apparatus and method for transporting sliver cans between a draw frame and a sliver supply station.

Can transporting apparatus are known for delivering full cans of sliver from a sliver supply station to a draw frame and return empty sliver cans from the draw frame to the sliver supply station. However, the need exists for a can transporting apparatus for a draw frame which optimally accommodates the competing design considerations of conserving space as much as possible while providing ready access for service personnel to the sliver cans at the draw frame.

SUMMARY OF THE INVENTION

The present invention provides a can transporting apparatus and a method for transporting cans between a draw frame and a sliver supply station of a textile machine which occupies relatively little space in contrast to known can transporting apparatus while providing ready access to the sliver cans at the draw frame.

Briefly described, the present invention provides a sliver can transporting apparatus for circulating sliver cans between a double row draw frame and a sliver supply station at which empty sliver cans are filled with sliver. The sliver can transporting apparatus includes inner track means having a final can ready position generally adjacent the double rows of the draw frame for supporting full sliver cans thereat in readiness for one-to-one exchange of the supported cans for empty sliver cans in a selected row of the double rows of the draw frame. The inner track means extending from the sliver supply station and including means for transporting full sliver cans along the inner track means from the sliver supply station to the final can ready portion. An outer track means having a preliminary can ready portion generally adjacent the final can ready portion of the inner track means for supporting a plurality of full sliver cans, the outer track means extending from the sliver supply station to the draw frame and the outer track means including means for transporting empty sliver cans along the outer track means from the draw frame to the sliver supply station.

The can transporting apparatus also includes sliver can discharge means for discharging empty sliver cans from the draw frame to the outer track means, final transfer means for transferring a full sliver can from the final can ready portion to the double rows of the draw frame and preparatory transfer means for transferring full sliver cans between the preliminary can ready portion and the final can ready portion. The final can ready portion includes means for supporting a plurality of full sliver cans in a row generally parallel to the double rows of the draw frame. The preliminary can ready portion includes means for supporting a plurality of full sliver cans in a row generally parallel to the row of full sliver cans supported at the final can ready portion.

According to one aspect of the present invention, the outer track transporting means includes means for transporting empty sliver cans from the draw frame through the preliminary can ready portion to the sliver supply station. Additionally, the final transfer means includes means for groupwise transfer of a row of full sliver cans at the final can ready portion to the double rows of the draw frame. Also, the preparatory transfer means includes means for groupwise transfer of a row of full sliver cans between the preliminary can ready portion and the final can ready portion.

According to a further aspect of the present invention, the inner track means and the double rows of the draw frame are spaced from one another to define a service passageway therebetween and the groupwise transfer means is operable to transfer full sliver cans from the final can ready portion through the service passageway to the double rows of the draw frames.

According to an additional aspect of the present invention, the outer track means includes an outlet portion extending from the draw frame to the preliminary can ready portion and an inlet portion extending from the preliminary can supply portion to the sliver supply station, the outlet and inlet portions each being transversely oriented with respect to the row of full sliver cans supported at the preliminary can ready portion. Also, the inlet portion slopes downwardly toward the sliver supply station.

According to a further aspect of the present invention, a method for circulating sliver cans of a textile machine between a double row draw frame and a sliver supply station at which empty sliver cans are filled with sliver is provided. The textile machine is of the type having inner track means having a final can ready portion generally adjacent the double rows of the draw frame for supporting full sliver cans thereat in readiness for one-to-one replacement for empty sliver cans in the double rows of the draw frame, and outer track means having a preliminary can ready portion generally adjacent the final can ready portion of the inner track means for supporting a plurality of full sliver cans, the outer track means extending from the sliver supply station to the draw frame. The method includes transporting a first plurality of full sliver cans along the inner track means from the sliver supply station to the final can ready portion, the first plurality of full sliver cans being equal in number to the sliver cans in a row of the double rows of the draw frame, transferring the first plurality of full sliver cans from the final can ready portion to the preliminary can ready portion of the outer track means and transporting a second plurality of full sliver cans along the inner track means from the sliver supply station to the final can ready portion, the second plurality of full sliver cans being equal in number to the sliver cans in a row of the double rows of the draw frame. Additionally, the method includes discharging empty sliver cans from the double rows of the draw frame onto the outer track means, transferring the second plurality of full sliver cans from the final can ready portion to the adjacent row of the double rows of the draw frame and transferring the first plurality of full sliver cans from the preliminary can ready portion to the other row of the double rows of the draw frame.

According to another aspect of the present invention, a method for circulating sliver cans of a textile machine between a double row draw frame and a sliver supply station at which empty sliver cans are filled with sliver is provided. The textile machine is of the type having inner track means having a final can ready portion generally adjacent the double rows of the draw frame for supporting full sliver cans thereat in readiness for one-to-one replacement for empty sliver cans in the double rows of the draw frame, and outer track means having a preliminary can ready portion generally adjacent the final can ready portion of the inner track means for supporting a plurality of full sliver cans, the outer track means extending from the sliver supply station to the draw frame. The method includes transporting a first plurality of full sliver cans along the inner track means from the sliver supply station to the final can ready portion, the first plurality of full sliver cans being equal in number to the sliver cans in a row of the double rows of the draw frame, transferring the first plurality of full sliver cans from the final can ready portion to the preliminary can ready portion of the outer track means and transporting a second plurality of full sliver cans along the inner track means from the sliver supply station to the final can ready portion, the second plurality of full sliver cans being equal in number to the sliver cans in a row of the double rows of the draw frame. Furthermore, the method includes discharging empty sliver cans from the remote one of the double rows of the draw frame onto the outer track means, transferring empty sliver cans from the adjacent row of the double rows of the draw frame to the remote row and transferring the second plurality of full sliver cans from the final can ready portion to the adjacent row of the double rows of the draw frame. Finally, the method includes transferring the first plurality of full sliver cans from the preliminary can ready portion to the final can ready portion of the inner track means and transferring empty sliver cans from the remote row of the double rows of the draw frame to the sliver supply station while transferring the second plurality of full sliver cans from the adjacent row to the remote row of the double rows of the draw frame and transferring the first plurality of full sliver cans from the final can ready portion of the inner track means to the adjacent row of the double rows of the draw frame.

DETAILED DESCRIPTION OF THE PREFERRED EMBODIMENT

In FIGS. 1–6, the can transporting apparatus and method of the preferred embodiment of the present invention is illustrated. A plurality of groups of draw frames and sliver supply stations are arranged serially with respect to one another. Each downstream group such as, for example, a group 21, comprises a pair of draw frames each having an associated sliver supply station for receiving textile strand material processed by an upstream group such as, for example, a group 20. As illustrated with respect to the upstream group 20, each group includes an assembly UA comprising one draw frame and its associated sliver supply station and a second assembly LA comprising another draw frame and its associated sliver supply station. Each draw frame and its associated sliver supply station is provided with a can transporting apparatus 22 of the present invention for delivering full sliver cans from the sliver supply station to the draw frame and for transporting empty sliver cans from the draw frame to the sliver supply station for refilling thereat.

Figure 2:
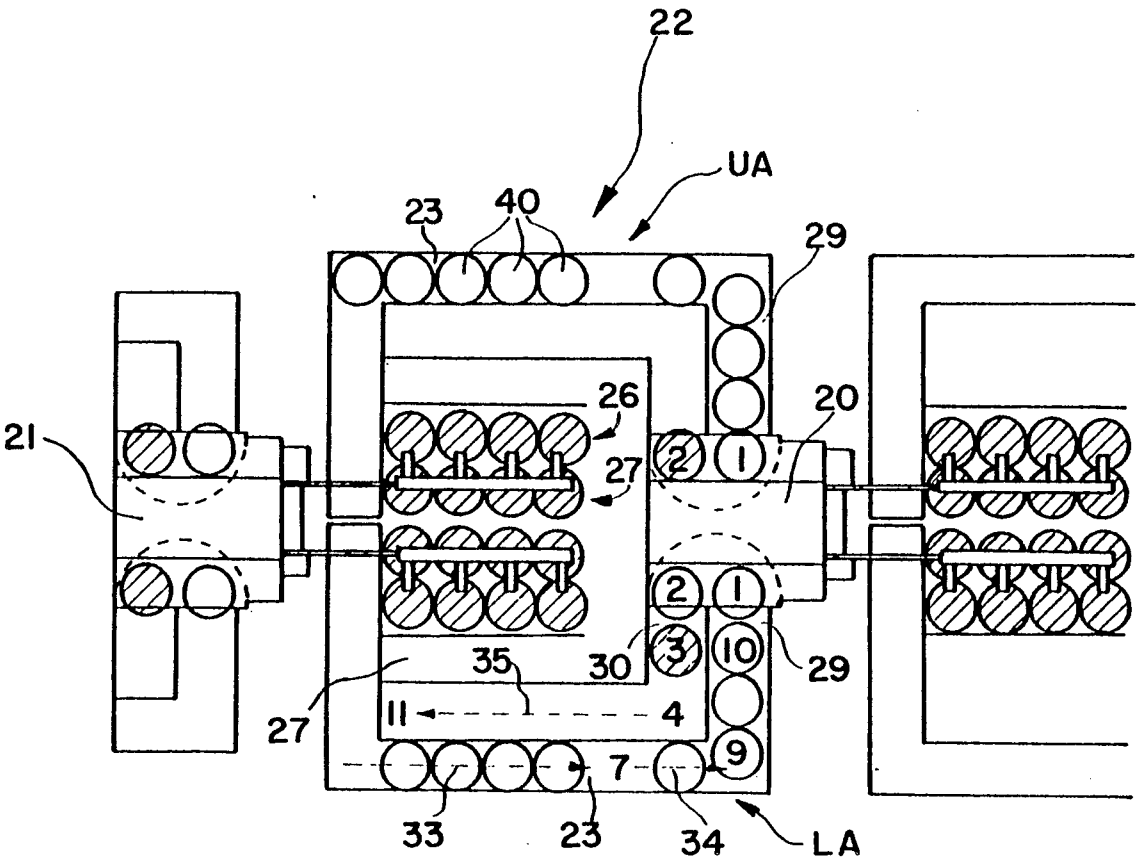
FIGS. 2–6 are schematic plan views of the draw frame arrangement shown in FIG. 1 at sequential stages in the can transport operation.

As seen with respect to the assembly UA in FIG. 2, the draw frame includes a pair of parallel rows 26, 27 of drafting stations for drafting textile strand material such as sliver from sliver can positioned at the double rows.

The can transporting apparatus 22 includes an inner track means or component 24 and an outer track means or component 23. The inner track component 24 includes a final can ready portion 11 generally adjacent and parallel the double rows of the draw frame for supporting full sliver cans thereat in readiness for one-to-one replacement of the supported cans for empty sliver cans in the adjacent rows 26 of the double rows of the draw frame. The inner track component 24 extends from the sliver supply station and includes conventional means for transporting full sliver cans along the inner track component from the sliver supply station to the final can ready portion 11. The means for transporting full sliver cans includes conventional endless belt assemblies for serially moving sliver cans along a predetermined path.

The outer track component 23 includes a preliminary can ready portion 15 generally adjacent the final can ready portion 11 of the inner track component 24 for supporting a plurality of full sliver cans. The outer track component 23 extends from the respective sliver supply station to the draw frame associated therewith. The outer track component 23 includes means for transporting empty sliver cans along the outer track component from the draw frame to the sliver supply station. The means for transporting full sliver cans includes conventional endless belt assemblies for serially moving sliver cans along a predetermined path.

The can transporting apparatus 22 additionally includes sliver can discharge means 31 for discharging empty sliver cans from the draw frame to the outer track component 23. The sliver can discharge means 31 includes a conventional endless belt assembly for transporting empty sliver cans from the inner row 27 of the draw frame to the outer track component 23. The can transporting apparatus 22 further includes a final transfer means 37 for transferring full sliver cans from the final can ready portion 11 of the inner track component 24 to the adjacent row of the double rows of the draw frame and a preparatory transfer means for transferring full sliver cans between the preliminary can ready portion 15 of the outer track component 23 and the final can ready portion 11 of the inner track component 24.

Figure 4:
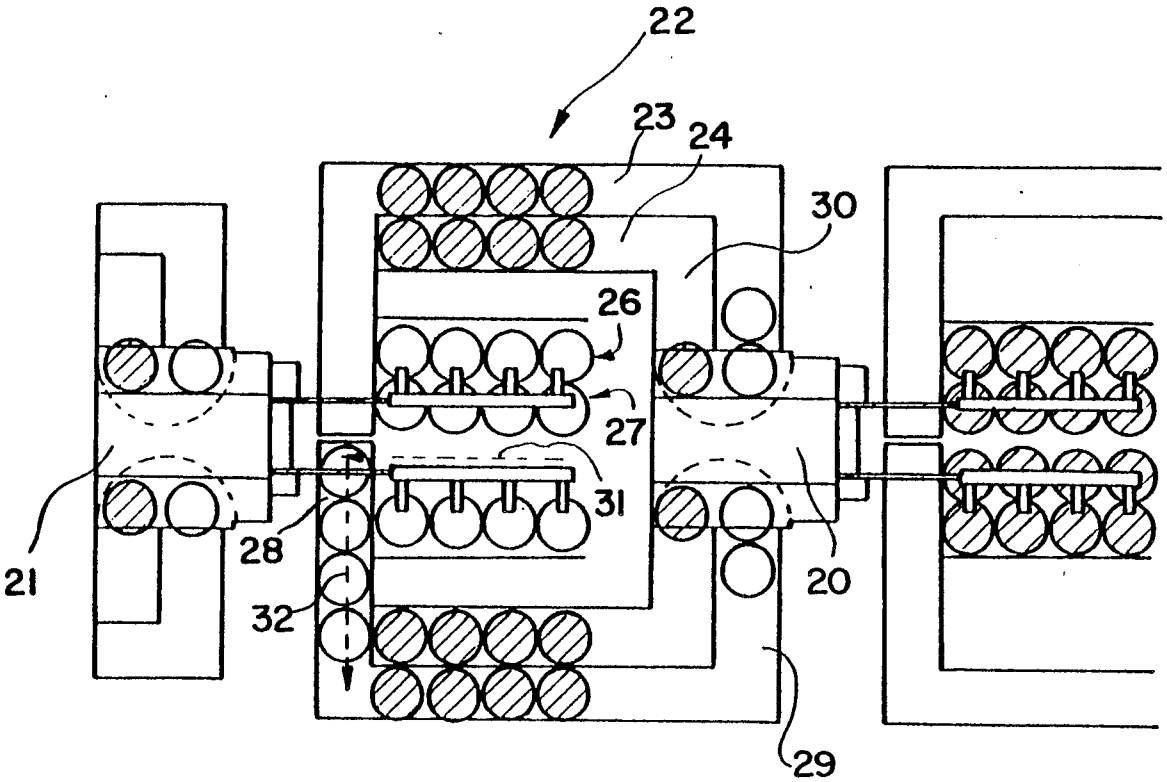

As seen in FIG. 4 with respect to the assembly UA, the outer track component 23 includes an outlet portion 28 extending from the draw frame to the preliminary can ready portion 15 and an inlet portion 29 extending from the preliminary can supply portion to the sliver supply station, the inlet portion 29 and the outlet portion 28 each being transverse to the preliminary can ready portion 15 of the outer track component. The inlet portion 29 slopes downwardly toward the sliver supply station for enhanced feeding of the empty cans thereto.

The inner track component 24 includes a portion 30 extending downwardly from the sliver supply station transverse to the final can ready portion 11 of the inner track component. The inner track component 24 is generally L-shaped with the final can ready portion 11 forming one end of the L and the portion 30 extending from the supply station forming the other leg of the L.

The outer track component 23 is generally U-shaped with the preliminary can ready portion 15 being formed in the linear base portion of the U and the outlet portion 28 and the inlet portion 29 defining the legs of the U. The L-shaped inner track component 24 is nested within the U-shaped outer track component 3 with the portion 30 of the inner track component extending from the sliver supply station generally adjacent and parallel to the inlet portion 29 of the outer track component 23.

Figure 1:
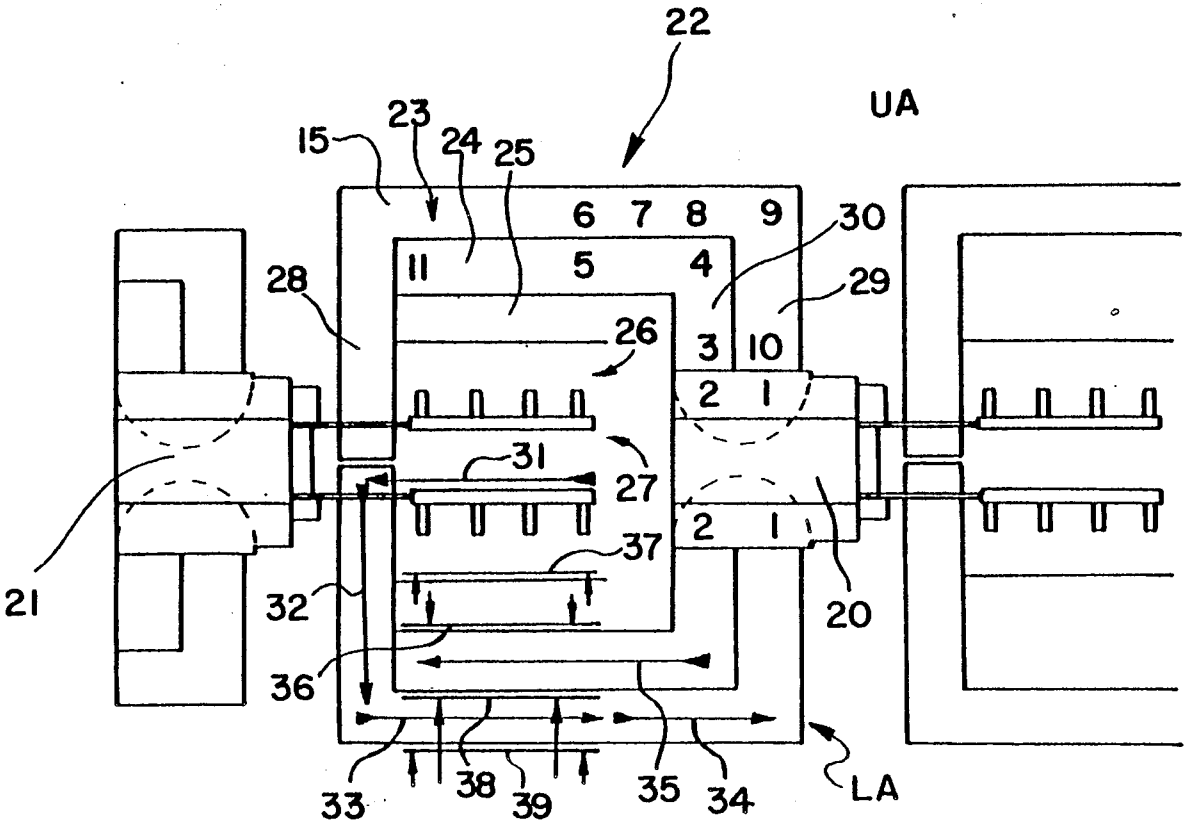
FIG. 1 is a schematic plan view of a draw frame arrangement of the type in which draw frames are connected in serial manner with one another and showing a pair of double row draw frames each having a can transporting apparatus according to the preferred embodiment of the present invention for circulating sliver cans between the draw frame and a sliver supply station.

As seen in FIG. 2, the conventional means for transporting full sliver cans along the inner track component 24 from the sliver supply station to the final can ready portion 11 includes a conventional endless belt assembly 35. As seen in FIG. 1, the conventional transport means of the outer track component 23 includes a conventional endless belt assembly 32 for transporting empty sliver cans delivered to the outer track component 23 by the draw frame discharge member 31 along the outer portion 28 to a conventional endless belt assembly 33 for transport of the empty sliver cans through the preliminary can ready portion 15 to another conventional endless belt assembly 34 that delivers the empty sliver cans to the raised end of the inlet portion 29 for sliding movement along the inlet portion into the sliver supply station, as seen in FIG. 2.

The final can ready portion 11 of the inner track component 24 includes means for supporting a plurality of full sliver cans in a row generally parallel to the double rows of the draw frame. The support means includes a conventional linear, planar track surface means along which a sliver can be slidably moved. The preliminary can ready portion 15 of the outer track component 23 includes means for supporting a plurality of full sliver cans in a row generally parallel to the row of full sliver cans supported by the final can ready portion 11 of the inner track component 24. The support means could be formed of conventional linear, planar track surface means which permits sliding movement therealong of a sliver can. The row supporting means of the inner track component 24 and the outer track component 23 are arranged in parallel, adjacent relationship. The row support means of the inner track component 24 is spaced from the adjacent row of the double rows of the draw frame to form a service passageway 25 therebetween for permitting access by service personnel to the sliver cans positioned at the double rows.

As seen in FIG. 1, the feed transfer means includes a plurality of spaced, parallel longitudinal bar members 36, 37 and 38, each bar member connected to a conventional movement means such as, for example, a conventional pneumatic cylinder and piston assembly, for translationally moving the bar member into and out of engagement with the full sliver cans at the final can ready portion 11 of the inner track component 24 to push the full sliver cans in a groupwise manner in a direction toward or away from the draw frame. In this regard, the longitudinal bar member 38 is positioned to push a group of full sliver cans at the final can ready portion 11 of the inner track component 24 from the final can ready portion 11 toward the draw frame to clear the service passageway 25. The longitudinal bar member 37 is positioned to push a group of full sliver cans which have cleared the service passageway 25 to the adjacent row of the double rows of the draw frame. The bar member 36 is positioned to push a group of full sliver cans from the final can ready portion 11 of the inner track component 24 in the direction away from the draw frame to the preliminary can ready portion 15 of the outer track component 23.

The preparatory transfer means includes a longitudinal bar member 39 extending parallel to the preliminary can ready portion 15 of the outer track component 23 and conventional movement means connected to the longitudinal bar member 39 for translationally moving the bar member to push a group of full sliver cans at the preliminary can ready portion 15 in the direction of the draw frame to the final can ready portion 11 of the inner track component 24.

In operation, the can transporting apparatus 22 operates as follows to continuously supply fresh full sliver cans to the double rows of the draw frame and to transport empty sliver cans from the draw frame to the sliver supply station for refilling of the cans with fresh loads. As seen in FIG. 2, the double rows 26, 27 of the draw frame are initially provided with a complement of full sliver cans and the sliver therein is appropriately fed to the drafting devices of the draw frame for drawing of the sliver from the full sliver cans by the draw frame. Each row 26, 27 of the draw frame is provided with a group of full sliver cans corresponding to the number of drafting stations of the draw frame. For example, each row 26, 27 is initially provided with four full sliver cans. Eleven other sliver cans are provided in the can transporting apparatus 22 so that a total of nineteen sliver cans are continuously in circulation in the system. To facilitate the following description of the operation of the can transporting apparatus 22, selected ones of the nineteen sliver cans are numbered.

As seen in FIG. 2, the sliver supply station receives cans sliding downwardly along the inlet portion 29 of the outer track component 23 for filling these empty sliver cans with full sliver loads. For example, during the operational period illustrated in FIG. 2, the sliver cans 1 and 2 are being filled with sliver loads. The cross-hatching on the sliver can 2 in the assembly UA illustrates that the sliver can has received its full load. In the assembly LA, a sliver can 3 having a full load has just been discharged by the sliver supply station onto the portion 30 of the inner track component 24 for sliding movement toward the endless belt assembly 35.

Figure 3:
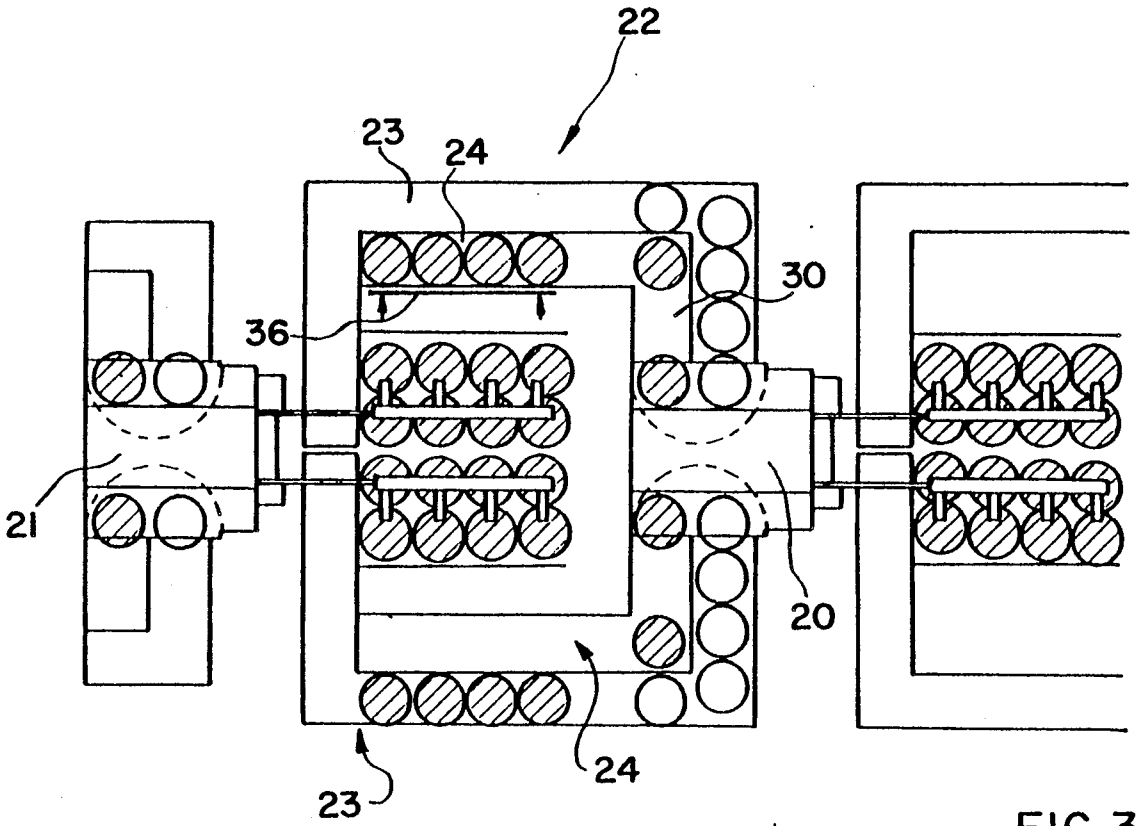

Accordingly, sliver cans refilled with full sliver loads are successively discharged from the sliver supply station to slide down the portion 30 of the inner track component 24 for movement of the full sliver cans by the endless belt assembly 35 to the final can ready portion 11 of the inner track component 24. Once a group of full sliver cans have been assembled at the final can ready portion 11 equal in number to the complement of sliver cans of one of the rows 26, 27, the longitudinal bar member 36 is operated to transfer the assembled group of full sliver cans in groupwise manner in a direction away from the draw frame from the final can ready portion 11 to the preliminary can ready portion 15 of the outer track component 23. As seen in FIG. 3, the thus-transferred group of full sliver cans is arranged in a row on the preliminary can ready portion 15 of the outer track component 23 while the sliver supply station continues to discharge full sliver cans down the portion 30 for transport of the cans by the endless belt assembly 35 to refill the final can ready portion 11 of the inner track component 24.

As seen in FIG. 4, another group of full sliver cans is eventually assembled at the final can ready portion 11 of the inner track component 24 as the sliver supply station continues to refill the arriving empty sliver cans. Empty cans are automatically fed to the sliver supply station due to the incline of the inlet portion 29 of the outer track component 23 toward the sliver supply station.

When the cans at the draw frame rows have emptied, can replacement takes place by first operating the draw frame discharge means 31 to discharge the empty cans from the inner row 27 onto the outlet portion 28 of the outer track component 23 for movement of the cans away from the draw frame by the endless belt assembly 32, as seen in FIG. 4.

Figure 5:
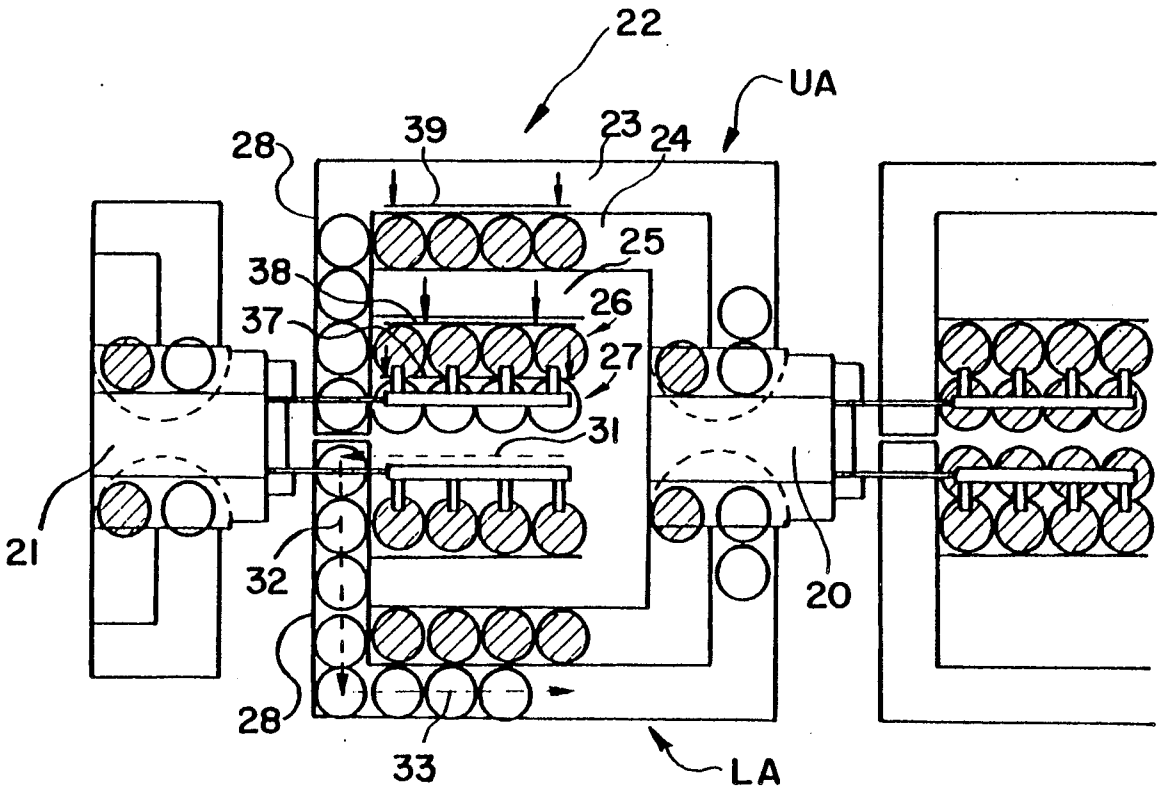

As illustrated with respect to the assemblY UA in FIG. 5, once the empty sliver cans of the row 27 have been discharged to the outlet portion 28, the longitudinal bar member 37 is operated to move the empty cans at the row 26 to the row 27. In correspondence with the movement of the empty cans of the row 26, the longitudinal bar member 38 is operated to transfer the group of full sliver cans on the final can ready portion 11 of the inner track component 24 from the final can ready portion 11 to the adjacent row 26. Subsequently, the longitudinal bar member 39 is operated to transfer the group of full sliver cans on the preliminary can ready portion 15 of the outer track component 23 in groupwise manner to the final can ready portion 11 of the inner track component 24.

As illustrated with respect to the assembly LA in FIG. 5, once the preliminary can ready portion 15 of the outer track component 23 is emptied of full sliver cans by movement of the longitudinal bar 39, the outer track component 23 is clear for the endless belt assembly 33 to transport empty sliver cans from the outer portion 28 through the preliminary can ready portion 15 to the endless belt assembly 34 and the inlet portion 29 for feed of the empty sliver cans to the sliver supply station.

Accordingly, the empty sliver cans in the row 26 are discharged to the outlet portion 28 and further transported by the endless belt assembly 33 through the preliminary can ready portion 15 while the group of full sliver cans at the adjacent row 26 are transferred by the longitudinal bar member 37 to the remote row 27 and the group of full sliver cans at the final can ready portion 11 are transferred by the longitudinal bar member 38 to the adjacent row 26.

In this regard, as seen in FIG. 2, the endless belt assemblies 33 and 34 can be operated in coordination with each other to maintain an area 7 free from sliver cans for passage therethrough of service personnel to the inner track component 24 and the service passageway 25.

Figure 6:
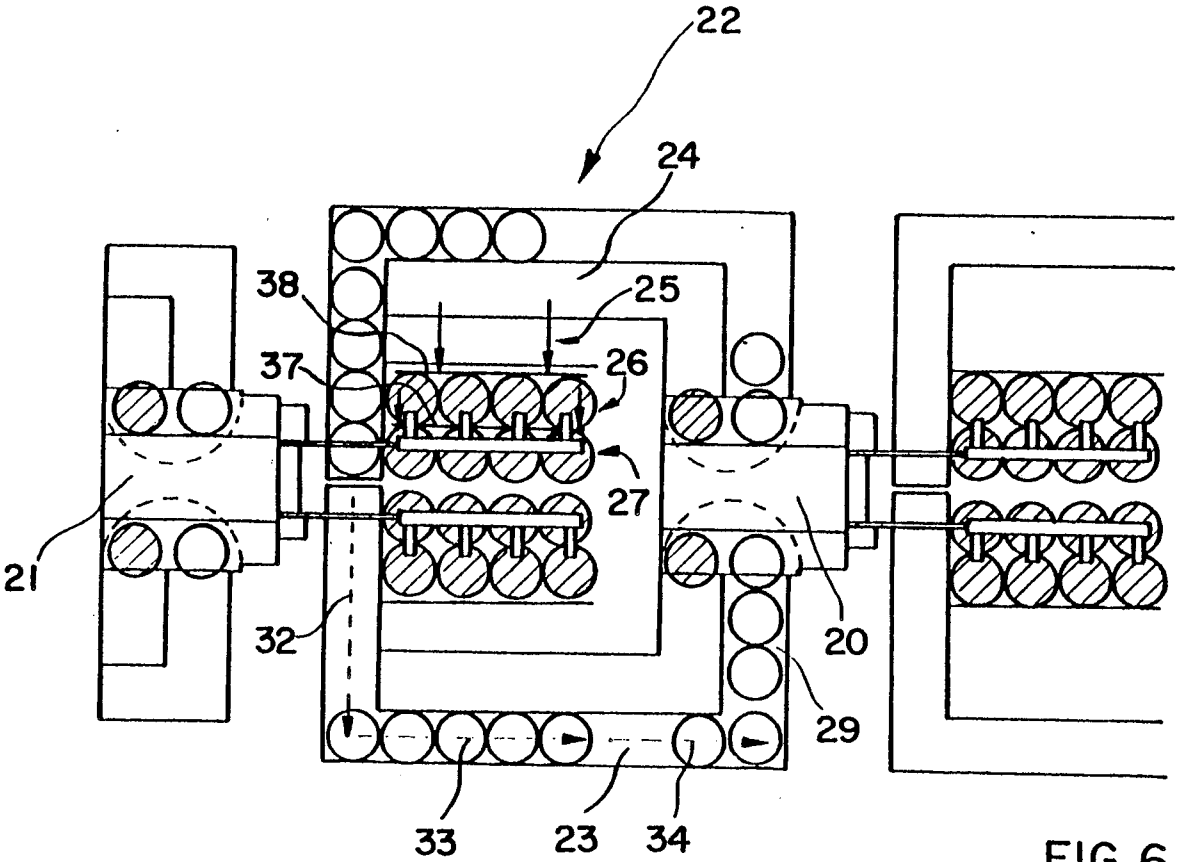

As illustrated with respect to the assembly UA in FIG. 6, the longitudinal bar member 37 is then operated to transfer the group of full sliver cans at the adjacent row 26 in groupwise manner to the remote row 27 and the longitudinal bar member 38 is operated to transfer the full group of sliver cans at the final can ready portion 11 of the inner track component 24 to the adjacent row 26. As illustrated with respect to the assembly LA in FIG. 6, while these transferring operations are occurring, the endless belt assemblies 32, 33 and 34 of the outer track component 23 continue to transport empty sliver cans to the inlet portion 29 for feed of the cans to the sliver supply station. The rows 26, 27 of the draw frame are thus provided with a fresh supply of full sliver cans and the can transporting apparatus 22 continues to operate in the manner described above to ready another supply of full sliver cans for transfer to the draw frame.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A sliver can transporting apparatus for circulating sliver cans between a double row draw frame and a sliver supply station at which empty sliver cans are filled with sliver, comprising:

inner track means having a final can ready portion generally adjacent the double rows of the draw frame for supporting full sliver cans thereat in readiness for one-to-one replacement for empty sliver cans in the double rows of the draw frame, said inner track means extending from the sliver supply station and including means for transporting full sliver cans along said inner track means from the sliver supply station to said final can ready portion;

outer track means having a preliminary can ready portion generally adjacent said final can ready portion 11 of said inner track means for supporting a plurality of full sliver cans, said outer track means extending from the sliver supply station to the draw frame and including means for transporting empty sliver cans along said outer track means from the draw frame to the sliver supply station;

sliver can discharge means for discharging empty sliver cans from the draw frame to said outer track means;

final transfer means for transferring full sliver cans from said final can ready portion to the double rows of the draw frame; and preparatory transfer means for transferring full sliver cans between said preliminary can ready portion and said final can ready portion.

2. A can transport system according to claim 1 and characterized further in that said final can ready portion includes means for supporting a plurality of full sliver cans in a row generally parallel to the double rows of the draw frame.

3. A can transport system according to claim 2 and characterized further in that said preliminary can ready portion includes means for supporting a plurality of full sliver cans in a row generally parallel to said row of full sliver cans supported at said final can ready portion.

4. A can transport system according to claim 3 and characterized further in that said means for transporting empty sliver cans includes means for transporting empty sliver cans through said preliminary can ready portion from the draw frame through said preliminary can ready portion to the sliver supply station.

5. A can transport system according to claim 2 and characterized further in that said final transfer means includes means for groupwise transfer of a row of full sliver cans at said final can ready portion to one of the double rows of the draw frame.

6. A can transport system according to claim 3 and characterized further in that said preparatory transfer means includes means for groupwise transfer of a row of full sliver cans between said preliminary can ready portion and said final can ready portion.

7. A can transport system according to claim 5 and characterized further in that said inner track means and the double rows of the draw frame are spaced from one another to define a service passageway therebetween and said groupwise transfer means is operable to transfer full sliver cans from said final can ready portion through said service passageway to the double rows of the draw frames.

8. A can transport system according to claim 1 and characterized further in that said inner track transport means includes an endless belt device on which sliver cans are transported.

9. A can transport system according to claim 1 and characterized further in that said outer track transport means includes an endless belt device on which sliver cans are transported.

10. A can transport system according to claim 3 and characterized further in that said outer track means includes an outlet portion extending from the draw frame to said preliminary can ready portion and an inlet portion extending from said preliminary can supply portion to the sliver supply station, said outlet and inlet portions each being transverse to said preliminary can ready portion.

11. A can transport system according to claim 10 and characterized further in that said inlet portion slopes downwardly toward the sliver supply station.

12. A can transport system according to claim 2 and characterized further in that said inner track means includes a supply portion extending from the sliver supply station, said supply portion being transverse to said final can ready portion.

13. A method for circulating sliver cans of a textile machine between a double row draw frame and a sliver supply station at which empty sliver cans are filled with sliver, the textile machine having inner track means having a final can ready portion generally adjacent the double rows of the draw frame for supporting full sliver cans thereat in readiness for one-to-one replacement for empty sliver cans in the double rows of the draw frame, and outer track means having a preliminary can ready portion generally adjacent the final can ready portion of the inner track means for supporting a plurality of full sliver cans, the outer track means extending from the sliver supply station to the draw frame, the method comprising:

transporting a first plurality of full sliver cans along the inner track means from the sliver supply station to the final can ready portion, said first plurality of full sliver cans being equal in number to the sliver cans in a row of the double rows of the draw frame;

transferring said first plurality of full sliver cans from the final can ready portion to the preliminary can ready portion of the outer track means;

transporting a second plurality of full sliver cans along the inner track means from the sliver supply station to the final can ready portion, said second plurality of full sliver cans being equal in number to the sliver cans in a row of the double rows of the draw frame;

discharging empty sliver cans from the double rows of the draw frame onto the outer track means;

transferring said second plurality of full sliver cans from the final can ready portion to the adjacent row of the double rows of the draw frame; and transferring said first plurality of full sliver cans from the preliminary can ready portion to the other row of the double rows of the draw frame.

14. The method according to claim 13 and characterized further in that said discharging empty sliver cans includes transporting the discharged empty sliver cans through the preliminary can ready portion to the sliver supply station.

15. A method for circulating sliver cans between a double row draw frame and a sliver supply station at which empty sliver cans are filled with sliver, the textile machine having inner track means having a final can ready portion generally adjacent the double rows of the draw frame for supporting full sliver cans thereat in readiness for one-to-one replacement for empty sliver cans in the double rows of the draw frame, and outer track means having a preliminary can ready portion generally adjacent the final can ready portion of the inner track means for supporting a plurality of full sliver cans, the outer track means extending from the sliver supply station to the draw frame, the method comprising:

transporting a first plurality of full sliver cans along the inner track means from the sliver supply station to the final can ready portion, said first plurality of full sliver cans being equal in number to the sliver cans in a row of the double rows of the draw frame;

transferring said first plurality of full sliver cans from the final can ready portion to the preliminary can ready portion of the outer track means;

transporting a second plurality of full sliver cans along the inner track means from the sliver supply station to the final can ready portion, said second plurality of full sliver cans being equal in number to the sliver cans in a row of the double rows of the draw frame;

discharging empty sliver cans from the remote one of the double rows of the draw frame onto the outer track means;

transferring empty sliver cans from the adjacent row of the double rows of the draw frame to the remote row;

transferring said second plurality of full sliver cans from the final can ready portion to the adjacent row of the double rows of the draw frame;

transferring said first plurality of full sliver cans from the preliminary can ready portion to the final can ready portion of the inner track means; and transferring empty sliver cans from the remote row of the double rows of the draw frame to the sliver supply station while transferring said second plurality of full sliver cans from the adjacent row to the remote row of the double rows of the draw frame and transferring said first plurality of full sliver cans from the final can ready portion of the inner track means to the adjacent row of the double rows of the draw frame.

* * * * *